United States Patent [19]

Quennessen

[11] Patent Number: 4,863,074

[45] Date of Patent: Sep. 5, 1989

[54] DISTRIBUTOR CAP ASSEMBLY FOR A PRESSURIZED CONTAINER

[75] Inventor: Rene Quennessen, Creteil, France

[73] Assignee: AMS Packaging, Saint-Ouen-L'Aumone, France

[21] Appl. No.: 129,734

[22] Filed: Dec. 7, 1987

[30] Foreign Application Priority Data

Dec. 5, 1986 [FR] France ..... 86 17084

[51] Int. Cl.[4] ..... B65D 83/00

[52] U.S. Cl. ..... 222/402.13; 222/402.24

[58] Field of Search ..... 222/402.13, 402.24, 222/402.15, 402.11, 183, 153

[56] References Cited

U.S. PATENT DOCUMENTS

| | | | |
|---|---|---|---|
| 2,887,273 | 5/1959 | Anderson et al. | 222/402.11 X |
| 2,998,165 | 8/1961 | Elorza | 222/402.13 X |
| 3,050,219 | 8/1962 | Sagarin et al. | 222/402.13 X |
| 3,198,399 | 8/1965 | Sagarin | 222/402.13 X |
| 3,474,939 | 10/1969 | O'Donnell et al. | 222/402.13 X |
| 3,618,827 | 11/1971 | Melocchi | 222/402.13 X |

*Primary Examiner*—Joseph J. Rolla
*Assistant Examiner*—Gregory L. Huson
*Attorney, Agent, or Firm*—Mason, Fenwick & Lawrence

[57] ABSTRACT

A distributor cap for a container (2) comprises a valve (3), whereof the movement causes the discharge—in particular the vaporization—of the product contained in the container (2). This cap comprising a fixed part (9) for connecting the cap (1) to the container (2) and a part (10) able to move with respect to the fixed part (9) and which co-operates with the valve (3) in order to allow its movement. The movable part (10) laterally surrounds the fixed part (9) which passes therethrough, and the fixed part (9) forms at least part of the transverse free end surface (12) of the cap (1). The fixed part (11) prevents the movable part (10) of the cap (1) from being depressed accidentally.

7 Claims, 3 Drawing Sheets

DISTRIBUTOR CAP ASSEMBLY FOR A PRESSURIZED CONTAINER

The invention relates to a distributor cap for a container comprising a valve whereof the movement causes the discharge—in particular the vaporization of the product contained in the container—this cap comprising a fixed part connecting the cap to the container and a movable part intended to co-operate with the valve.

The invention also relates to a container provided with such a cap and a method of fitting the cap to the container.

The invention is applicable, mainly but in a nonlimiting manner, on the one hand to containers of the vaporizer or spray or atomizer type which are sealed hermetically and for which each movement of the valve causes the vaporization of a constant quantity of product and on the other hand to containers of the aerosol spray type having a propellant gas for which the quantity of vaporized product is proportional to the time during which the valve is depressed. Hereafter the word "vaporizer" and its derivatives are used in a non-limiting manner to designate the two types of technology and refer to devices making it possible to spray a liquid in fine droplets.

Distributor caps are already known for containers such as a spray bottle for cosmetic products in which the fixed and movable parts are cylindrical, the movable part sliding inside the fixed part and projecting upwards and outside the fixed part.

Distributor caps are also known in which the cylindrical movable part covers the fixed part. The drawback of these caps is that there is a risk of the movable part being accidentally depressed at the time of transportation, storage, packing . . . In addition, the shape of the cap does not indicate clearly the direction of vaporization, which is dangerous. Distributor caps of this type are described in the following documents No. FR 2 088 986, GB No. 967 950, ; in which case, in order to be actuated, the movable cap must be put in a certain angular position then pressed and GB No. 1 131 041 in which it must solely be pressed.

Finally distributor caps are known in which the fixed part forms an extension of the container in order to improve the aesthetics of the arrangement. The fixed part projects upwards and outwards with respect to the movable part in order to form a stop preventing accidental actuation at the time of transportation, storage, packing etc.

In a first known variation, the fixed part comprises a slit allowing access to the push button or to the movable part. The drawback of this device is that it is not very aesthetic and does not provide adequate guidance of the movable part, which may cause damage to the support rod and vaporization device.

In a second known variation, the movable part is guided in translation in the fixed part which is higher in order to form a stop. However, a device of this type is difficult to handle since the finger must be pushed inside the fixed part. In addition, the shape of the cap does not indicate clearly the direction of vaporization.

The invention intends to remedy the drawbacks of the known arrangements and relates to a distributor cap such that in combination:

the cap is aesthetic, that is to say in harmony with the container and forms an arrangement concealing the functional members.

the valve or push button is perfectly guided at the time of its movements.

no doubt exists as regards the direction in which the vaporization will take place and should allow easy actuation.

the movable part of the cap co-operating with the valve cannot be depressed accidentally, for example at the time of transportation, storage, packing . . .

the cost price of the cap is as low as possible, that is to say that the cap comprises only few parts, each part being simple to manufacture and of low cost.

fitting of the cap to the container is easy and quick but totally effective.

Another object of the invention is a distributor cap having an aesthetic appearance breaking away from that of caps of the prior art, in particular by providing a surprising and unusual aesthetic effect when it is actuated, for example, whereof the changes in appearance at the time of actuation cannot be guessed at a first glance.

To this end, the invention proposes a distributor cap for a container comprising a valve whereof the movement causes the discharge—in particular the vaporization—of the product contained in the container, comprising a fixed part comprising means for fitting the cap to the container and a part which is movable with respect to the fixed part and which co-operates with the valve in order to allow its movement, characterised in that the movable part laterally surrounds the fixed part which passes therethrough and in that the fixed part forms at least part of the transverse, free end surface of the cap, the fixed part preventing the movable part of the cap from being depressed accidentally. The fixed part projects towards the outside of the movable part at least when the movable part is moved.

Means are preferably provided for limiting the movements of the movable part with respect to the fixed part, which means are arranged so that, when inoperative, the movable part is flush at least substantially with the fixed part, these two fixed and movable parts forming the free end surface of the cap.

According to the invention, a cap for a container comprising a valve which moves in translation along one axis is characterised in that the movable part is mounted to slide axially with respect to the fixed part along one axis, preferably the axis of movement of the valve and radially surrounds the fixed part which passes axially therethrough.

The fixed and movable parts are preferably cylindrical or pseudo-cylindrical. The fixed part guides the movable part positively as it slides axially around the fixed part. The fixed part is constituted by a lower skirt and an upper cover. The movable part is constituted by an outer skirt surrounding the lower skirt of the fixed part and by an actuating tongue. The cover of the fixed part still projects upwards with respect to the outer skirt of the movable part in order to form a safety stop preventing inopportune actuation of the tongue, in particular at the time of transportation, storage, packing etc. . . . The outer skirt has a small radial thickness.

The invention also relates to a container comprising a distributor cap according to the invention and a method of assembling a distributor cap according to the invention and a method of fitting a cap according to the invention to a container according to the invention.

In a method of assembly according to the invention, the lower skirt of the fixed part is connected to the container, then the movable part is fitted around this lower skirt, then the cover is rigidly connected to the upper edge of the lower skirt.

The invention provides a cap and a container whereof the aesthetics may be greatly improved with respect to the prior art. In particular, the fact that the movable part surrounds the fixed part, apart from the surprising technical advantages, gives a surprising aesthetic effect to the extent that the user cannot anticipate from a simple glance, the movements which will be produced by actuating the tongue. A cap and a container according to the invention are thus highly attractive. In addition, the invention provides all the above-mentioned technical advantages, namely:

the tongue indicates the direction of vaporization without ambiguity and facilitates handling;

the valve is perfectly guided owing to the positive guidance of the movable part by the fixed part;

the fitting of the cap to the container is easy and effective.

Further features and advantages of the invention will become apparent on reading the ensuing description of a preferred embodiment, referring to the accompanying drawings in which.

Figure 1:
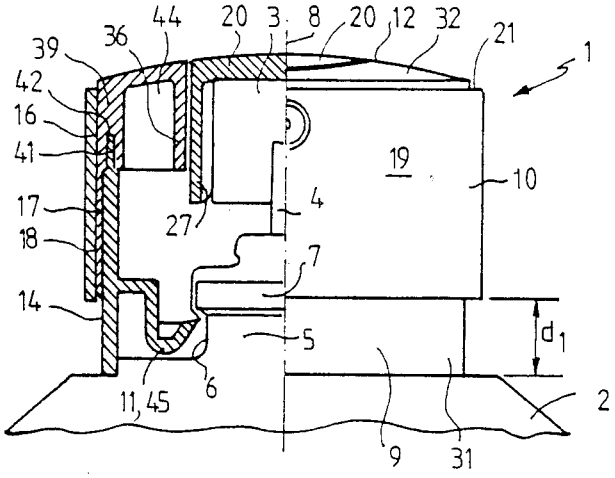
FIG. 1 is a half-view in the right-hand part and a half-section in the left-hand part on line III—III of FIG. 3, of a distributor cap according to the invention when inoperative.

The invention relates to a distributor cap 1 for a container 2 comprising a valve 3. The valve 3 is connected to a conduit 4 through which the product contained in the container 2 may flow at the time of displacement of the valve 3. The conduit 4 forms part of a device which is known per se connected to the neck 5 having a mouth 6 of the container 2 by a flange 7.

The neck 5 and the conduit 4 define an axis 8 of symmetry along which the valve 3 is moved in translation in one direction or the other. The movement of the valve 3 along the axis 8 in a given direction, for example towards the container 2, causes the discharge—in particular the vaporization—of the product contained in the container 2.

Generally, when the container 2 rests in its position, the axis 8 is vertical and the cap 1 is situated at the upper end of the container 2. This is why, for reasons of simplicity, we shall refer hereafter to this reference position, although the position of the container 2 is not determining and may be any whatever.

Furthermore, hereafter, the qualifications "axial" and "radial" refer, unless stated otherwise, to the axis of symmetry 8.

The cap 1 comprises two parts: a fixed part 9 and a movable part 10. The fixed part 9 comprises means 11 for fitting the cap 1 to the container 2. It is fitted rigidly, in a fixed but generally removable manner to the container 2, for example to the flange 7. The part 10 is able to move with respect to the fixed part 9, in particular by sliding axially and co-operates, in particular in a rigid but detachable manner, with the valve 3, in order to allow it to move in translation. In this way, the manual action of the user on the movable part 10 is transmitted to the valve 3. The outer shape of the movable part 10 is preferably adapted in order to facilitate this manual action, such as the application of the user's finger.

In the absence of any external pressure, the movable part 10 and the valve 3 are returned to the upper end position or locked position—so-called inoperative position (FIGS. 1, 3, 4, 7, 8) furthest from the container 2, by return means (not shown) integrated in known manner in the device for discharging the product.

Figure 2:
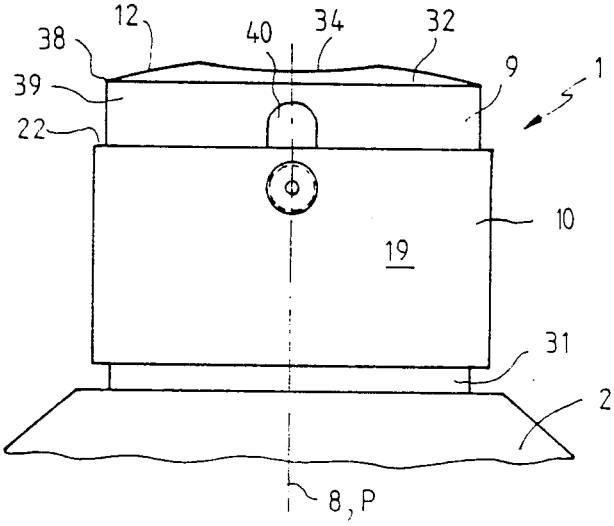
FIG. 2 is an elevational view of a distributor cap according to the invention, when actuated.
Figure 3:
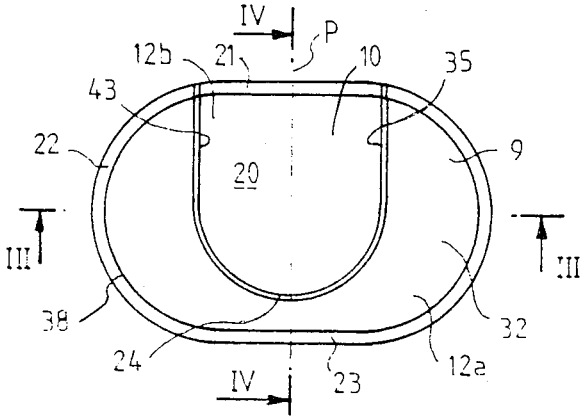
FIG. 3 is a plan view of a distributor cap according to the invention, when inoperative.
Figure 5:
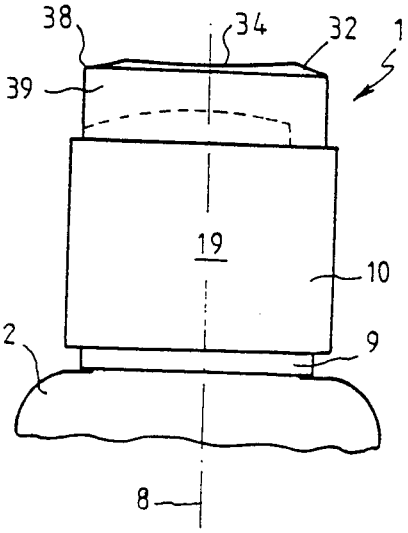
FIG. 5 is a view from the left of FIG. 2.
Figure 7:
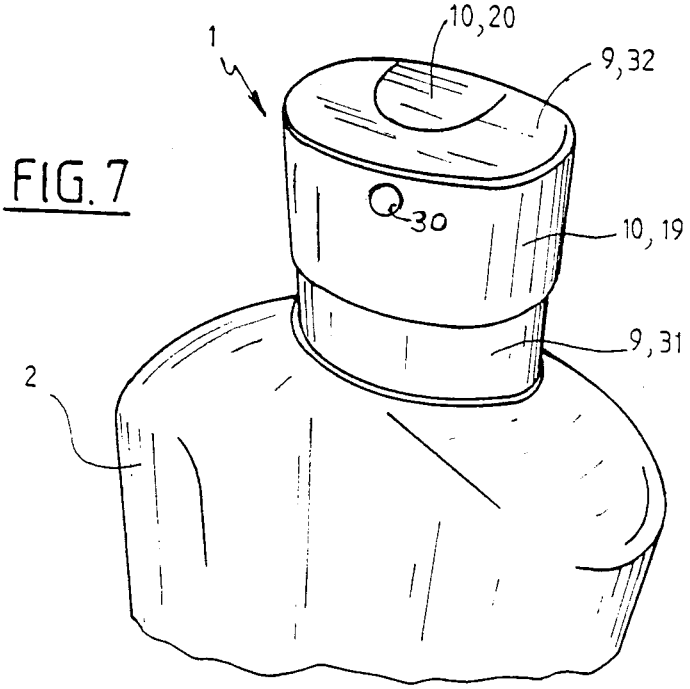
FIG. 7 is a partial diagrammatic perspective view of a container according to the invention, provided with a cap according to the invention, when inoperative.

In order to carry out a vaporization of product, the user urges the movable part 10 and through the intermediary thereof, the valve 3 to leave the inoperative position and causes it to slide into a lower extreme locking position, the so-called actuated position, closest to the container 2 (FIGS. 2, 5).

According to the invention, the movable part 10 laterally surrounds the fixed part 9 passing through the movable part. In addition, the fixed part 9 constitutes at least one part of the upper, transverse free end surface 12 of the cap 1, the fixed part 9 preventing the movable part 10 of the cap 1 from being depressed accidentally. The fixed part 9 projects axially towards the outside of the movable part 10, that is to say away from the container 2 and this is at least when the movable part 10 is moved. In the embodiment illustrated, the fixed part 9 thus projects beyond the movable part 10 in an upwards direction, at least when actuated.

Preferably and in the embodiment illustrated, the valve 3 is mounted to slide axially, the movable part 10 is also movable with respect to the fixed part 9 in translation along an axis—in particular along the axis 8 of movement of the valve 3, which is the axis of symmetry of the neck 5 and of the stem 4—and the movable part 10 radially surrounds the fixed part 9 which passes through it axially.

The invention may clearly be applied to other embodiments for which the respective axes of translation of the valve 3 and of the movable part 10 do not coincide, indeed are not parallel, indeed also when the movement of the valve 3 is more complicated than simple axial sliding.

A cap according to the invention comprises means 13 for limiting the travel of the movable part 10 with respect to the fixed part 9, whereof the main function is to maintain the co-operation of the fixed part 9 and movable part 10. According to the invention, the limiting means 13 are arranged so that, when inoperative, the movable part 10 is flush with the fixed part 9 in order to form the free end surface 12 of the cap 1.

Figure 4:
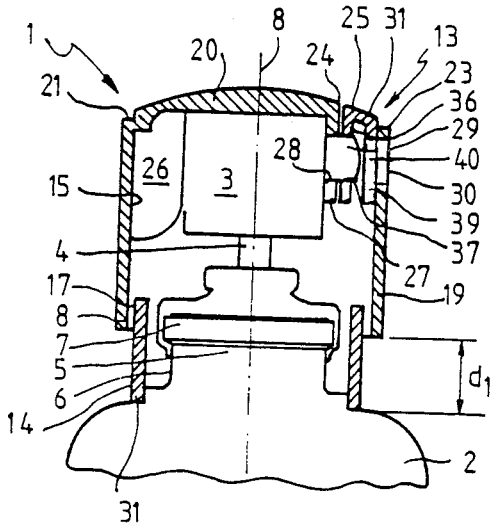
FIG. 4 is a section on line IV—IV of FIG. 3.

When the cap 1 is inoperative, the free end surface **12*b* of the movable part 10 continuously extends the free end surface 12*a* of the fixed part 9. To do this, this free end surface 12*b* of the movable part 10 could comprise points which are slightly more extreme than the free end surface 12*a* of the fixed part 9 (FIGS. 1, 4). However, it is clear that any accidental pressing action on the free end surface 12 of the cap, for example by a wall of the packaging, will have the effect solely of moving the movable part 10 slightly or not moving it at all from the inoperative position, the fixed, free end surface 12*a* forming a stop and preventing a genuine accidental actuation of the cap 1. Thus, the product cannot be vaporized accidentally at the time of transportation, storage etc. When inoperative, the upper, free end surface 12 of the cap 1 constitutes surfaces 12***a*, 12*b* which are advantageously slightly curved in the upwards direction.

The respective opposing internal surfaces 15 of the movable part 10 and external surfaces 14 of the fixed part 9 are at least substantially cylindrical or pseudo-cylindrical, their axes being parallel to each other and to the axis 8 of movement of the movable part 10. The term "cylindrical" is in this case used in its most general sense. The term "pseudo-cylindrical" calls to mind the fact that these surfaces 14, 15 may be constituted by one or more portions or frustums of cylinders. The terms internal and external refer to the orientation with respect to the axis 8 of movement of the movable part 10. The overall axial height of the external surfaces 14 of the fixed part 9 which are opposite internal surfaces 15 of the movable part 10 is less than the overall axial height of these internal surfaces 15 of the movable part 10. The external surfaces 14 of the fixed part 9 follow the shapes of the internal surfaces 15 of the movable part 10, whilst allowing axial sliding and positive guidance of the movable part with respect to the fixed part 9.

The internal surfaces 15 of the movable part 10 are at least partly in contact along the external surfaces 14 of the fixed part 9, in order to constitute positive guide means for this movable part 10 in its axial sliding movement with respect to the fixed part 9. One could provide specific means, not shown, for improving guidance and sliding, for example contact rings. This contact of the movable part 10 and fixed part 9 may be provided along cylindrical portions 16 solely of these parts 10, 9, a radial clearance 17 is provided outside these portions 16. In the example illustrated, contact occurs solely in the upper portions 16 of the external surfaces 14 of the fixed part 9 and internal surfaces 15 of the movable part 10. A radial clearance 17 separates the lower portions 18.

The movable part 10 comprises an outer cylindrical skirt 19 and at least one tongue 20 for actuating the valve 3 extending substantially radially towards the inside 26 of the skirt 19 from at least one portion 21 of its upper edge 22. If necessary, the valve 3 and the tongue 20 may be made in one piece.

This tongue 20, connected rigidly to the portion 21 of the edge 22, does not extend as far as the portion 23 of the edge 22 opposite and symmetrical to the portion 21 with respect to the axis 8. The tongue 20 has a free end 24 in the radial direction, opposite the portion 21 of the upper edge 22 of the skirt 19 from which it extends and this free end 24 is separated from the skirt 19, i.e. from the facing portion 23, so that a portion 25 of the fixed part 9 may be inserted between the free end 24 of the tongue 20 and the facing portion 23 of the upper edge 22 of the outer skirt 19 of the movable part 10. This portion 25 considerably increases the efficiency of the stop formed by the free end surface 12*a* of the fixed part 9, preventing accidental actuation. The tongue 20 is shaped at its end surface 12*b* in the axial direction so that an actuation by the finger on this tongue 20 is easy. This upper surface 12*b* of the tongue 20 is the end surface 12*b* of the movable part 10 in the axial direction. Its shape is thus also adapted in order to be continuously flush with the end surface 12*a* of the fixed part 9 (FIG. 1).

The tongue 20 comprises means for retaining the valve 3. In order to do this, the tongue 20 is extended downwards in the axial direction by a skirt 27 which surrounds the valve 3. By its surface which is not in contact with the valve 3, this skirt 27 also advantageously forms an inner surface 15 of the movable part 10. The skirt 27 extends over all or part of the height of the valve 3. Moreover, the tongue 20 comprises at its free end 24, through the skirt 27, an orifice 28 for the passage of a channel 29 for the discharge of the product, which projects radially towards the outside of the valve 3 and this orifice 28, the outer skirt 19 of the movable part 10 comprising a hole 30 opposite the orifice 28 which allows the passage of the vaporized product. At its free end, the channel 29 comprises a vaporization valve.

The walls of the fixed part 9 forming external surfaces 14 interposed between the free end 24 of the tongue 20 and the outer skirt 19 of the movable part 10 also comprise an opposing hole allowing the passage of the product and the clearance of the channel 29 of the valve 3.

Preferably, (FIG. 6) the movable part 10 is formed in one piece, for example, from moulded synthetic material, constituting the outer skirt 19 and the tongue 20.

The fixed part 9 comprises a lower skirt 31 for fitting to the container 2 and a cover 32 covering over at least partly the lower skirt 31. The cover 32 comprises a recess 34 allowing the passage of the actuating tongue 20. The surface 33 defined by the upper edge 42 of the lower skirt 31 is thus completely covered by the cover 32 of the fixed part 9 and by the tongue 20 of the movable part 10.

The edge 35 of the recess 34 is extended downwards (axially towards the container 2) by a skirt 36 for guiding the tongue 20, whereof the surface follows the shapes thereof, that is to say which follows the shape of the skirt 27 of the tongue 20 with which it comes into contact.

The cover 32 covers the lower skirt 31 of the fixed part 9 and the discharge channel 29 projecting from the actuating tongue 20 through the orifice 28. Since the cover 32 is fixed and the movable part 10 is integral with the channel 29 through the orifice 28 in the tongue 20, the fact that the cover 32 covers this channel 29 constitutes the means 13 for limiting the travel of the movable part 10 in its axial sliding movement in an upwards direction with respect to the fixed part 9. In its skirt 36 for guiding the tongue 20, a cover 32 comprises a hole 37 elongated axially for the passage of the discharge channel 29. This hole 37 allows the movements of the channel 29 thus limiting them in the upwards direction.

The outer edge 38 of the cover 32 is extended downwards by a skirt 39 for guiding the outer skirt of the movable part 10. A hole 40 elongated axially is also provided through this guide skirt 39 for the passage of the product. Preferably, the channel 29 does not penetrate this hole 40 (FIG. 4). The guide skirt 39 is in contact at 16 with the portion of the outer skirt 19 of the movable part 10 in order to guide it. In addition, this skirt 39 of the cover 32 comprises means 41 for the rigid connection of the cover 32 to the lower skirt 31 of the fixed part 9. In fact, according to the invention, the fixed part 9 is formed of two separate members rigidly connected one to the other: the cover 32 and the lower skirt 31. The rigid connection means 41 are constituted for example by a slot 41 extending axially in the thickness of the skirt 39 of the cover 2 and in which the upper edge 42 of the lower skirt 31 of the fixed part 9 is inserted by force. The skirt 39 of the cover 32 has a radial thickness greater than the lower skirt 31 of the fixed part 9 so that the edge 42, possibly thinned down, may be inserted in the slot 41. This also has the effect of creating a radial clearance 17 between the lower skirt 31 of the fixed part 9 and the outer skirt 19 of the movable part 10 which are not in contact (FIG. 1).

In order to improve the means 13 for limiting the travel of the movable part 10 with respect to the fixed part 9, it is possible to provide a flange (not shown) radially extending the edge 38 of the cover 32 and covering the upper edges 22 and/or 43 of the outer skirt 19 and/or of the movable tongue 20 and forming an abutment against this edge 22 and/or 43.

In the embodiment illustrated, the skirts 36 and 39 of the cover 32 forming the external guide surfaces 14 for the tongue 20, respectively the outer skirt 19 of the movable part 10, are separate and separated from each other by an empty space 44. However, it is clear that this space 44 may be solid, the two skirts 36, 39 meeting each other.

According to the invention, the cover 32 of the fixed part 9 permanently projects towards the outside, in particular upwards, with respect to the outer skirt 19 of the movable part 10, the tongue 20 being flush with or projecting slightly towards the outside and towards the top of this cover 3, in the inoperative position, so that the cover 32 forms a safety stop preventing the accidental actuation of the tongue 20, in particular at the time of transportation, storage, packing etc.

The outer skirt 19 of the movable part 10 has a small radial thickness and increases only slightly the bulk of the cap 1 with respect to the fixed part 9.

When inoperative, the lower skirt 31 of the fixed part 9 projects downwards by a distance $d_1$ of the outer skirt 19 of the movable part 10, the distance $d_1$ being at least equal to the travel of the valve 3. This allows a sufficient movement of the movable part 10 with respect to the fixed part 9. Similarly, the skirt 39 of the cover 32 for guiding the skirt 19 of the movable part 10 has a height greater than or equal to the distance $d_1$, so that the movable skirt 19 is always guided by the fixed skirt 39.

Figure 6:
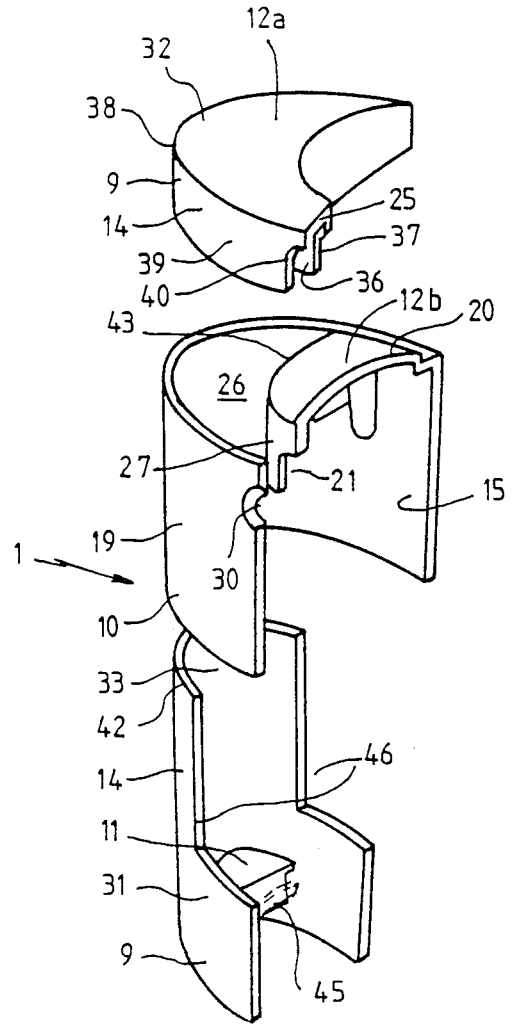
FIG. 6 is a half-perspective view showing the various parts forming a distributor cap according to the invention and their method of assembly.

The cap 1 according to the invention is symmetrical with respect to a plane P containing the axial direction of movement of the valve 3 and the substantially radial direction of vaporization. FIG. 6 shows only half the cap 1, cut through the plane P.

In cross-section, the lower skirt 31 of the fixed part 9 has at least substantially the shape of an ellipse and the means 11 for connecting the cap 1 to the container 2 are housed symmetrically with respect to the plane P in the vertices of the ellipse, in the lower part of the skirt 31. The connecting means 11 which are symmetrical with respect to P, are constituted for example, in each vertex of the ellipse, by a pawl 45 whereof the shape is known and adapted to co-operate with the flange 7 of the container 2. These means 11 are advantageously formed in one piece with the lower skirt 31 of the fixed part 9.

The lower skirt 31 of the fixed part 9 advantageously comprises recesses 46 in its upper part concealed by the movable part 10 and this is in order to lighten the arrangement and to prevent any interference between the movable part 10, in particular the tongue 20 and the valve 3 at the time of movements of the movable part 10.

A guarantee device (not shown) may also be provided in the form either of ties which can easily be broken between the tongue 20 and the cover 32, or also in the form of a peripheral band connected in a detachable manner to the outside of the lower skirt 31 of the fixed part 9, below the outer skirt 19 of the movable part 10, when inoperative.

The invention also relates to a container 2, in particular an atomizer bottle or an aerosol spray having a propellant gas, comprising a distributor cap according to the invention.

According to the invention, the overall radial bulk of the container 2 is greater than that of the cap 1. The container 2 comprises a hermetic sealing device comprising a flange 7 and the means 11 for connecting the cap 1 to the container 2 are means 45 for the snap engagement of the inner fixed part 9 of the cap 1 on the flange 7.

The invention finally relates to a method for fitting a cap 1, according to the invention, on a container 2 according to the invention, characterised in that the lower skirt 31 of the fixed part 9 of the cap 1 is connected to the container 2—in particular by snap-action with the flange 7, then the movable part 10 is mounted around this lower skirt 31, then the cover 32 is connected rigidly—in particular by sticking, welding or equivalent—to the upper edge 42 of the lower skirt 31.

Preferably, the valve 3 previously disconnected from the container 2 is introduced into the retaining means below the tongue 20 before mounting the movable part 10 around the fixed lower skirt 31, the effect of this mounting of the movable part 10 also being to once more connect the valve 3 to the container 2, in particular to the conduit 4.

The invention may have numerous variations of construction which are obvious to a man skilled in the art, in particular as regards the external appearance and the shapes given to the container and to the cap.

I claim:

1. A distributor cap assembly for a container for fluid under pressure comprising, an axially slidable valve member, a fixed part forming a rigid assembly including means for connection to the container, a first cylindrical surface portion concentric with the axis of the distributor cap assembly, and a cover portion having a recess, such cover portion projecting to a position exposing a portion thereof to form the free upper end of the distributor cap assembly, and a rigid, one piece axially slidable part movable axially with respect to the fixed part having a second cylindrical surface extending concentric with the axis of the distributor cap assembly located outwardly adjacent and close to said first cylindrical surface of the fixed part and guided thereby, a tongue having means for retaining and actuating the valve extending radially form an upper edge of said second cylindrical surface and rigidly secured to it, a hole in said second cylindrical surface adjacent the valve for passage of fluid spray therethrough, and said tongue being located flush with said cover portion of the fixed part so as to prevent any accidental actuation of the tongue during transportation, packing or storage.

2. A distributor cap assembly according to claim 1, wherein said slidable part is mounted for axial sliding movement with respect to said fixed part along an axis paralleling said axis of the distributor cap assembly and radially surrounds said fixed part, the fixed part passing axially therethrough.

3. A distributor cap assembly according to claim 1, including means for limiting the travel of said slidable part with respect to said fixed part, said means for limiting travel being arranged such that said slidable part is flush over a substantial portion thereof with said fixed part to form a free end surface of the cap.

4. A distributor cap assembly according to claim 1, wherein said first cylindrical surface of said fixed part follows the shapes of said second cylindrical surface of said slidable part while allowing axial sliding and positive guidance of said slidable part with respect to said fixed part.

5. A distributor cap assembly as defined in claim 1, wherein the axial height of said first cylindrical surface of said fixed part facing said second cylindrical surface of said slidable part is less than the axial height of the latter.

6. A distributor cap assembly according to claim 1, wherein said slidable part comprises an outer cylindrical skirt, and said tongue for actuating the valve extends substantially radially toward the inside of the skirt from at least one portion of its upper edge.

7. A distributor cap assembly according to claim 6, wherein the tongue, at its free end, comprises an orifice for the passage of pressurized product from the container therethrough, and said outer skirt of said slidable part includes a hole opposite said orifice to allow passage of the product.

* * * * *